US005311682A

United States Patent [19]

Sturdivant

[11] Patent Number: 5,311,682

[45] Date of Patent: May 17, 1994

[54] HYBRID DREDGE

[76] Inventor: Charles N. Sturdivant, 5120 Pine Hill Rd., Nashville, Tenn. 37221

[21] Appl. No.: 1,840

[22] Filed: Jan. 7, 1993

[51] Int. Cl.[5] ..... E02F 3/34

[52] U.S. Cl. ..... 37/312; 37/320; 37/317; 37/341; 37/346

[58] Field of Search ..... 37/71, 73, 59, 54, DIG. 1, 37/341, 345, 346, 320, 317, 307, 309, 312

[56] References Cited

U.S. PATENT DOCUMENTS 3,352,035 11/1967 Joyce .
3,973,575 8/1976 Sullivan et al. .
4,052,800 10/1977 Fuhrboter et al. .
4,357,764 11/1982 Lemercier et al. .
4,399,623 8/1983 Neumann ..... 37/73
4,485,569 12/1984 Matsumae et al. ..... 37/73
4,628,623 12/1986 Deal ..... 37/DIG. 1 X
4,680,879 7/1987 Hill et al. .
4,718,835 1/1988 Maruyama ..... 37/DIG. 1 X
5,042,178 8/1991 Dutra ..... 37/71
5,072,991 12/1991 Rohr ..... 37/71 X
5,083,386 1/1992 Sloan ..... 37/DIG. 1 X

*Primary Examiner*—Randolph A. Reese
*Assistant Examiner*—J. Russell McBee
*Attorney, Agent, or Firm*—Mark J. Patterson; Edward D. Lanquist, Jr.; I. C. Waddey, Jr.

[57] ABSTRACT

A hybrid dredging apparatus uses a clamshell attached to a rigid boom to dig and remove material. The clamshell then deposits the material into the hopper of a positive displacement pump for discharge at low velocities and with minimal water content. Transducers are be used to determine and control the area of excavation.

8 Claims, 4 Drawing Sheets

HYBRID DREDGE

BACKGROUND OF THE INVENTION

The present invention relates generally to apparatus for removing material from the bottom of a water filled reservoir and more particularly to a dredge which uses a novel combination of both mechanical clamshell and hydraulic dredge technology.

It will be appreciated by those skilled in the art that there are two primary types of dredges currently in use. A mechanical dredge uses a clamshell or dragline positioned from a floating base to dig and remove solid material from beneath the water. There are a number of difficulties created by the use of conventional clamshell and dragline dredges. First, the clamshell is typically suspended and allowed to free fall through the water so that it will impact the bottom with sufficient force to penetrate and dig into the material to be removed. This disturbs the surrounding sediments, causing re-suspension into the water of particles and contaminants. Similar disturbances are produced by pulling a dragline randomly through the sediments. The accuracy of positioning of the clamshell or dragline during these operations is less than optimal as well. Second, the clamshell or dragline bucket must be dumped either immediately behind the dredge, or in a scow or dump truck, for transportation to a disposal site. The cost and difficulty of this type of transportation limits the application of the clamshell dredge.

To address some of the drawbacks of mechanical dredges, many have begun using the hydraulic dredge which uses a cutting device to loosen material from the bottom and a centrifugal pump to transport the dredged material in the form of a slurry. Typically, the water content of the slurry ranges from seventy percent (70%) to one hundred percent (100%), with pipe line velocities maintained at between seven (7) feet to fifteen (15) feet per second in order to achieve adequate particulate suspension. Because of the high water content of the slurry and high pump velocities, disposal of the slurry is a problem, particularly if it contains hazardous waste material. A common method of dealing with the disposal problem is to pump the slurry into a lagoon or settling basin and let the excess water run-off. This may or may not be permitted by regulatory authorities because the water may contain hazardous constituents. Conventional hydraulic dredges are sometimes inappropriate for use with materials such as paper mill sludge that, when disturbed, change characteristics to the point that they cannot effectively settle or de-water in the disposal lagoon.

Finally, prior art dredging systems do not easily accommodate either visual inspection of the removed sediment or pre-pumping processing of the sediment by screening, grinding and the like.

U.S. Pat. No. 3,352,035 issued to F. Joyce on Nov. 14, 1967, discloses one type of hydraulic dredge. Unfortunately, this type of dredge is only useable with fine and soft material because of the limitation created by the dredge hose.

U.S. Pat. No. 3,973,575 issued to A. Sullivan, et al on Aug. 10, 1976, discloses another type of hydraulic dredge which uses a shovel which is dragged along the ocean bottom. This type of cutter creates a large amount of re-suspension thereby decreasing the efficiency of the hydraulic dredge. Further, it is difficult to control the area of excavation with a dragline.

U.S. Pat. No. 4,052,800 issued to A. Fuhrboter, et al on Oct. 11, 1977, also discloses a shovel which is towed by one boat and a hydraulic dredge which is towed by another boat. As stated above, the problem with this apparatus is that the centrifugal pump has a low solid to water content thereby decreasing the efficiency of the hydraulic dredge. Further, the dragline causes significant re-suspension of materials. Also, the area of excavation is difficult to control.

U.S. Pat. No. 4,357,764 issued to P. Lemercier on Nov. 9, 1982, discloses a vehicle which uses a vertical auger system. Unfortunately, this device has very limited application because the vehicle will quickly fill up and will not be able to carry any more dredged material. Further, the device is very complicated in that the vehicle must drive under water.

U.S. Pat. No. 4,680,879 issued to C. Hill, et al on Jul. 21, 1987, discloses a hydraulic dredge having a cutter head. As stated repeatedly throughout, the standard hydraulic dredge pulls in water at a low solid to water ratio thereby decreasing the efficiency of the dredge.

U.S. Pat. No. 5,042,178 issued to B. Dutra on Aug. 27, 1991, discloses a clamshell dredge and hopper which uses water jets for the reduction of relatively dry solids into a high density slurry for the purpose of filling a barge. The clamshell is suspended from a line thereby making it difficult to control excavation.

What is needed, then, is a dredge apparatus which can move dredged material a substantial distance away from the dredge without a high concentration of water and at low velocities. This apparatus also should allow for precise control of the removal process underneath the water and without significant re-suspension of particulate at the dredging location. This device is presently lacking in the prior art.

SUMMARY OF THE INVENTION

The dredging apparatus of the present invention incorporates a hybridization of mechanical and hydraulic dredging technology. A clamshell bucket is attached to a rigid extensible boom on a floating platform to dig and remove the material at its in situ water content. The platform is fixed in position by adjustable spuds which extend from the platform to the bottom of the water reservoir. The clamshell deposits the material into the hopper of a positive displacement pump. This type of pump can transport the material to the disposal area or a facility in a relatively dry form at low slurry velocities. Particulate suspension (underwater) is limited by the controlled excavation. The azimuth and angle of declination of the clamshell boom are adjustable. Transducers are used to provide data as to clamshell position and to closely control the area of excavation.

Accordingly, one object of the present invention is to provide a dredge which produces a pumpable slurry with a high concentration of solids and low concentration of water.

Still another object of the present invention is to provide a dredging apparatus which excavates with minimal re-suspension of sediments.

Another object of the present invention is to provide a dredge which allows precise excavation of sediments.

A further object of the present invention is to provide a dredge which allows visual examination of excavated sediments.

Another object of the present invention is to provide a dredge which allows front end processing of the sediment slurry, such as size reduction, prior to pumping.

DESCRIPTION OF THE PREFERRED EMBODIMENT

Figure 1:
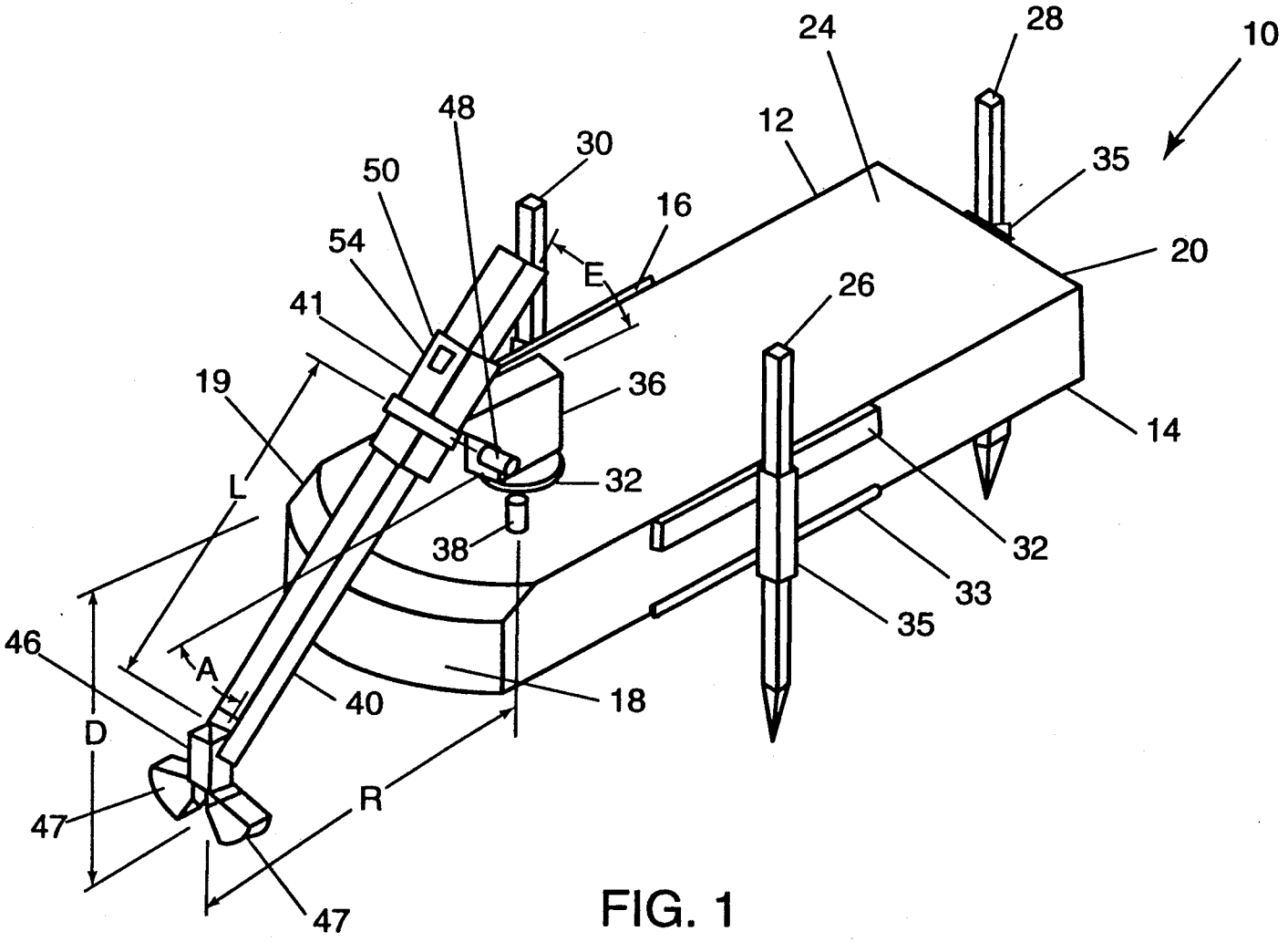
FIG. 1 is a perspective view of the dredging apparatus of the present invention.
Figure 3:
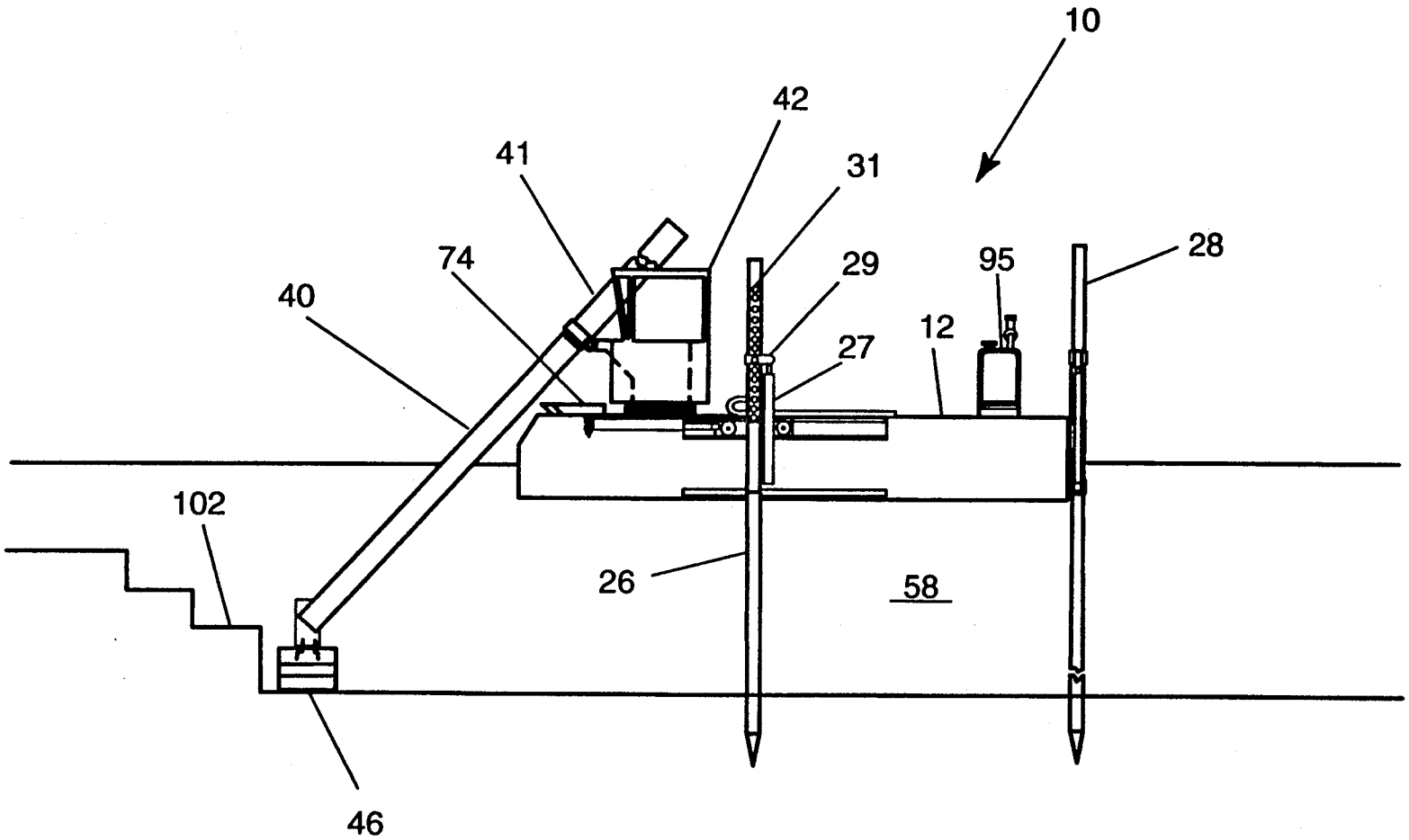
FIG. 3 is a side view of the dredging apparatus of the present invention showing the clamshell boom in an extended position.

Referring now to FIG. 1 there is shown generally at 10 the dredging apparatus for dredging a bottom of a reservoir of the present invention. Dredging apparatus 10 generally includes a floating platform 12 to which is mounted a turntable mast 36 supporting a clamshell boom 40 and three spuds 26, 28, and 30. Platform 12 is of conventional construction with left side panel 14, right side panel 16, lower and upper front panels 18 and 19, rear panel 20, bottom panel 22, and deck panel 24 forming a hollow, rectangular buoyant stable platform. Typically, platform 12 floats on reservoir 58 and is positioned over the sediment area 102 to be dredged (FIG. 3). However, platform 12 can be secured to the land, a dock, a pier, a piling, or can be submerged.

Figure 4:
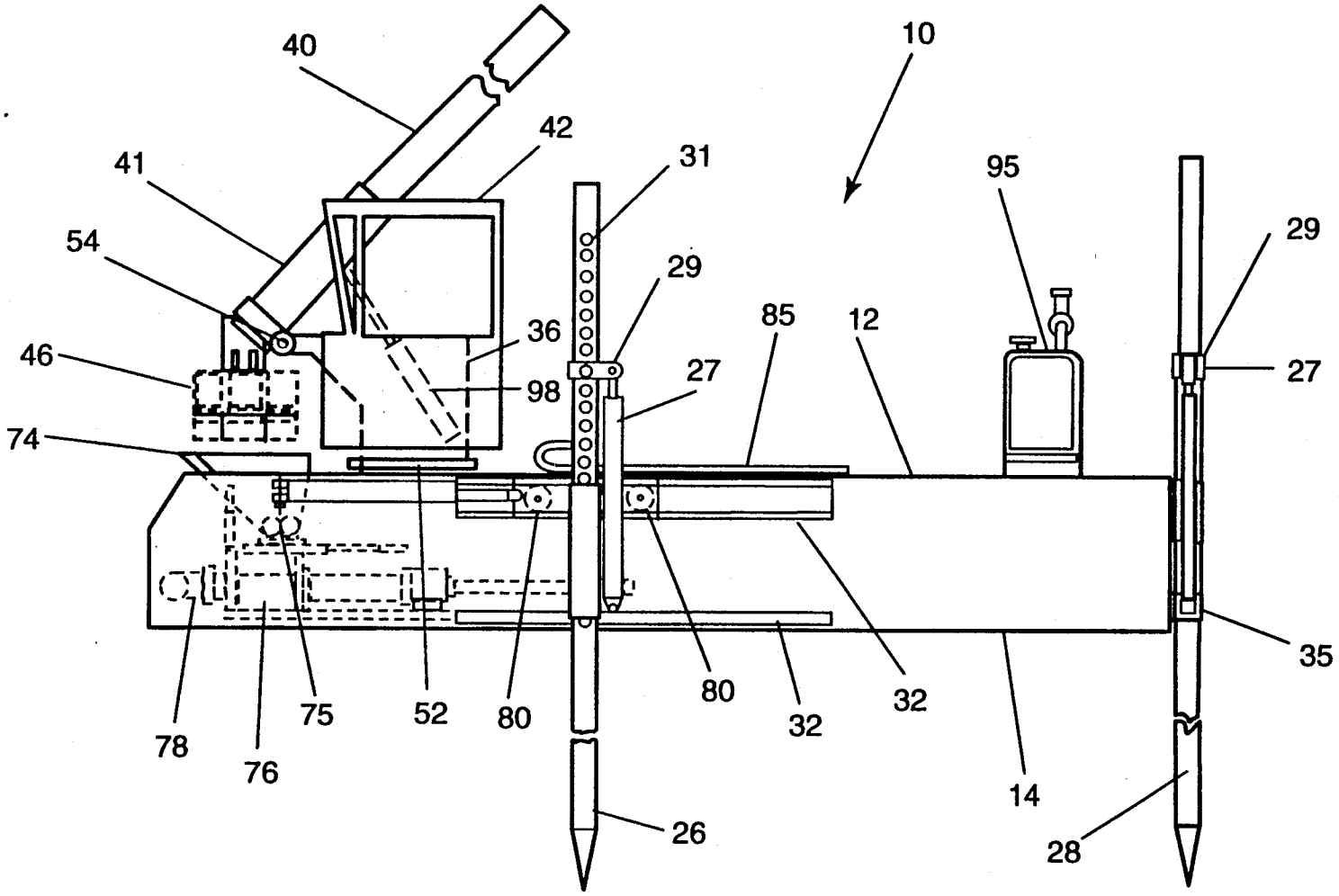
FIG. 4 is a side and partial phantom view of the dredging apparatus of the present invention showing the clamshell boom in a retracted position.

The vertical and horizontal position of platform 12 is controlled in part by left side traveling spud 26, rear spud 28, and right side traveling spud 30. Referring to FIG. 4, left side spud 26 attaches to left side panel 14 and right side spud 30 to right side panel 16 by means of spud carriages 35 which engage upper and lower spud tracks 32 and 33. Spud track bearings 80 allow left and right side spuds 26 and 30 to be moved laterally along platform 12 to a preferred position for dredging operations. Rear spud 28 attaches to platform 12 at or proximate to rear panel 20, also by spud carriage 35 which is fixed laterally. Spuds 26, 28, and 30 are moved vertically within carriages 35 by means of spud lift cylinders 27. Cylinder 27 is attached at its lowest point to the lower portion of carriage 35 while the extensible piston of lift cylinder 27 is adjustably attached to each spud 26, 28, 30 by spud collar 29. The range of vertical travel effected by cylinder 27 is adjustable by varying the point of attachment of collar 29 to spud pin holes 31. Hydraulic hose 85 supplies the necessary hydraulic fluid, under pressure, to cylinder 27.

Referring now to FIG. 4, mast 36 attaches to or proximate to deck panel 24 of platform 12 at by means of rotating turntable bearing 52. Operator cab 42, from which the dredge operator controls and monitors operations of the dredge, is attached to mast 36 so that cab 42 and the operator will rotate along with turntable 52. Mast 36 rotates about bearing 52 using standard rotation drive means such as a gear drive, a direct drive motor, a belt drive, a chain drive, and the like. Also operatively attached to turntable mast 36 is azimuth angle position transducer 38 which is conventional rotary position transducer responsive to the angular position "A" of mast 36, as shown on FIG. 1.

Clamshell boom 40 is rigid and supported by boom bracket 41 which attaches to mast 36 at pivot bracket 54, thereby allowing boom 40 to pivot in the vertical plane. Declination angle position transducer 48, also of a conventional rotary position indicating type, is responsive to the angle of declination "E" shown on FIG. 1. In the preferred embodiment, a hydraulic boom pivot cylinder 98 (FIG. 4) is used to adjust and control the angle of declination. Transducers 38, 48 not only measure the angles of rotation, they also measure the speed of rotation thereby giving a user or controller measurements of speed as well as angles.

Figure 2:
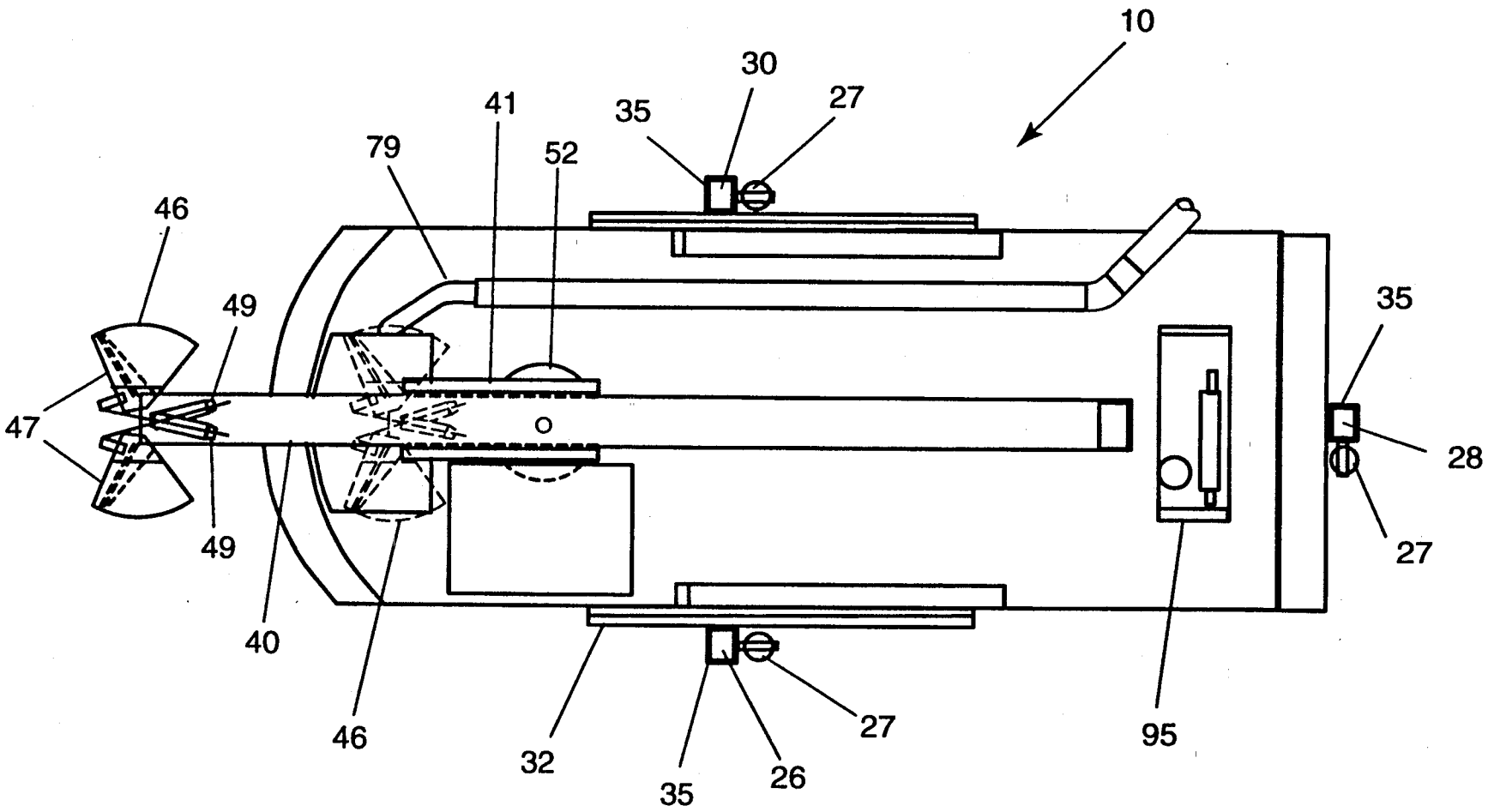
FIG. 2 is a plan view of the dredging apparatus of the present invention.

Boom 40 extends and retracts such that sediment can removed as shown in FIG. 3 when boom 40 is extended and then deposited in sediment hopper 74 when boom 40 is retracted as shown on FIG. 4. Extension of boom 40 is produced in a conventional manner by hydraulic cylinders or similar devices. As shown in FIG. 1, clamshell extension transducer 50 attaches to boom 40 to measure the linear extension of boom 40. In the preferred embodiment, a linear velocity and displacement transducer is used which allows for measurement of extension distance as well as velocity of extension or retraction. Clamshell 46 is pivotally attached to boom 40 and clamshell buckets 47 can be opened and closed by means of bucket cylinders 49 shown on FIG. 2.

Referring again to FIG. 1, one can see how the area of dredging and position of clamshell bucket 46 can be computed using data from transducers 38, 48, and 50. Azimuth angle "A" is measured by azimuth angle position transducer 38. Length or extension "L" of boom 40 is determined by clamshell extension transducer 50. Angle of declination "E" is measured by declination angle position transducer 48. The depth "D" of clamshell bucket 46 can then be determined by:

$$D = L \text{ sine } E$$

The reach "R" or linear position ahead of platform 12 of bucket 46 is determined by:

$$R = L \text{ cosine } E$$

By charting reaches and depths, both the area as well as the volume of material dredged can be determined.

In the preferred embodiment, transducers 38, 48, and 50 are electronically linked to conventional analog to digital convertors and a data processor, such as a PC or programmable logic controller (not shown), which calculates the positional rate of movement parameters and displays them for the operator as well as saves them as a record of the dredging operations that have been completed. This allows for very precise control of the clamshell 46 against the dredging floor, as shown on FIG. 3. Optionally, additional or different platform positioning data can be supplied to the data processor from a conventional Global Positioning System (GPS) which uses satellite data to accurately pinpoint the position of the target GPS receiver. The processor can be configured to completely excavate the area within the range of the dredge by systematically making a grab, depositing the material into the pump hopper, and returning to make another grab immediately adjacent to, or overlapping, the last grab.

Looking at FIG. 4, when boom 40 is retracted to move clamshell 46 to a position over hopper 74, clamshell buckets 47 open and dump the dredged sediment into the open end of hopper 74. Hopper 74 delivers the sediment to the input port of a positive displacement pump 76 which pumps dredged sediment from hopper 74 into and through pump discharge 78 and discharge hose 79 at typical sediment velocities of one to two feet per second. Typical positive displacement pumps include piston and progressing cavity designs. Discharge hose 79 can deliver the dredged sediment to a floating barge, to shore, or any place desired. Optionally, a sediment pre-processing device 75 can be placed intermediate pump 76 and hopper 74 for screening, grinding, or shredding of the dredged material.

Referring now to FIG. 4, it can be seen that operator cab 42 can double as an observation point from which the operator can view hopper 74 to determine the type and character of the sediment being removed and adjust operations accordingly.

By using only hydraulic devices for movement of all adjustable components, a single hydraulic pump and motor assembly 95 with conventional valves and controls can be used.

In the preferred embodiment, the hybrid dredge 10 produces a pumpable slurry with a high concentration of solids and a low concentration of water because only ambient sediment water is removed. Clamshell 46 is driven into the sediments at low speed by the force of the hydraulic system. This minimizes disturbance and re-suspension of the surrounding sediments as is created by conventional clamshells and draglines.

Thus, although there have been described particular embodiments of the present invention of a new and useful hybrid dredge, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. An apparatus for dredging material from a bottom of a fluid reservoir comprising:
   a. a floating platform;
   b. a rigid telescoping boom mounted to said platform;
   c. means to rotate said boom horizontally with respect to said platform;
   d. means to pivot said boom vertically with respect to said platform;
   e. a clamshell attached to said boom; and
   f. a positive displacement pump means for pumping said dredged material from said platform without the use of additional fluid for suspension of said material.

2. The dredging apparatus of claim 1 further comprising at least one spud attached to and extending below said platform for engaging said reservoir bottom.

3. The dredging apparatus of claim 1 further comprising transducer means for generating data from which the extension of said clamshell, the horizontal angular position of said clamshell, and the depth of said clamshell can be calculated.

4. The dredging apparatus of claim 3 further comprising at least one vertically adjustable spud attached to and extending below said platform for engaging said reservoir bottom.

5. The dredging apparatus of claim 4 wherein at least one spud is laterally adjustable.

6. The dredging apparatus of claim 5 further comprising an operator cab rotatably mounted to said platform, said cab providing an operator a view of said dredged material upon delivery to said pump.

7. A method for dredging material from an area on a bottom of a reservoir, said method comprising the steps of:
   a. restricting movement of a platform floating on said reservoir proximate to said bottom area;
   b. rotating a rigid, telescoping boom in a horizontal plane in relation to said platform;
   c. pivoting said boom on a vertical plane in relation to said platform;
   d. extending a clamshell in an opened position to said bottom, said clamshell attached to said boom;
   e. penetrating said bottom with said extended clamshell;
   f. closing said clamshell; and
   g. retracting said closed clamshell;
   h. collecting said material from said clamshell in a hopper attached to said platform; and
   i. pumping said material from said platform using a positive displacement piston pump mounted on said platform.

8. The method of claim 7 further comprising the steps of:
   a. measuring the angle of vertical pivoting of said boom;
   b. measuring the angle of horizontal rotation of said boom;
   c. measuring the linear extension of said boom; and
   d. computing and controlling the area and position of dredging using said measurements of said vertical pivoting, said horizontal rotation, and said extension.

* * * * *